United States Patent [19]

Azzato et al.

[11] 4,335,659

[45] Jun. 22, 1982

[54] RESTORABLE GANG APPARATUS FOR TELEPHONE BOOK BINDERS

[75] Inventors: Robert N. Azzato, Phoenix, Ariz.; Henry N. Staats, Deerfield; Neal J. Morrissey, Chicago, both of Ill.

[73] Assignee: General Binding Corporation, Northbrook, Ill.

[21] Appl. No.: 73,568

[22] Filed: Sep. 7, 1979

[51] Int. Cl.[3] ..... A47B 97/04

[52] U.S. Cl. ..... 108/28; 248/447

[58] Field of Search ..... 248/447; 312/233; 108/28

[56] References Cited

U.S. PATENT DOCUMENTS

| | | | |
|---|---|---|---|
| 1,796,496 | 3/1931 | Volkmar | 312/233 |
| 2,862,329 | 12/1958 | Guinane et al. | 248/447 |
| 3,228,648 | 1/1966 | Tils | 312/233 X |
| 3,275,279 | 9/1966 | Caldwell et al. | 312/233 X |
| 3,918,672 | 11/1975 | Torn | 248/447 |

*Primary Examiner*—William H. Schultz

*Attorney, Agent, or Firm*—Hill, Van Santen, Steadman, Chiara & Simpson

[57] ABSTRACT

A restorable gang apparatus for telephone books which includes a main frame having a top shelf and spaced end plates depending downwardly generally at opposite ends of the shelf with one or more telephone books being normally storable on the bottom side of the shelf. A series of book mounting units are suspended in side by side relation from beneath the top shelf between the spaced end plates when in a storage position. Each unit is comprised of the following elements. An inclined track hanger means suspends the inclined track in an inclined position where an outer end of the track is more elevated than an inner or rearward end of the track. Telephone book carrier structure is disposed beneath and mounted on the telephone book carrier structure. Means are provided for mounting the telephone book onto the telephone book carrier structure. A truck having slidable bearing means is mounted on the track for back and forth movement on the inclined track. Rotatable pivot means suspend the telephone book carrier structure from the truck. A handle is operatively connected to the telephone book carrier structure and pullable in a direction to cause the truck to move upwardly on the track and for placement of the rotatable pivot means in adjacency to a front edge of the table top and for then enabling the telephone book carrier structure to rotate on its rotatable pivot means for positioning at least a portion of the telephone book carrier structure in overlying relation to the table top for placing the telephone book carrier structure and the telephone book in a viewing position.

6 Claims, 9 Drawing Figures

FIG. 3
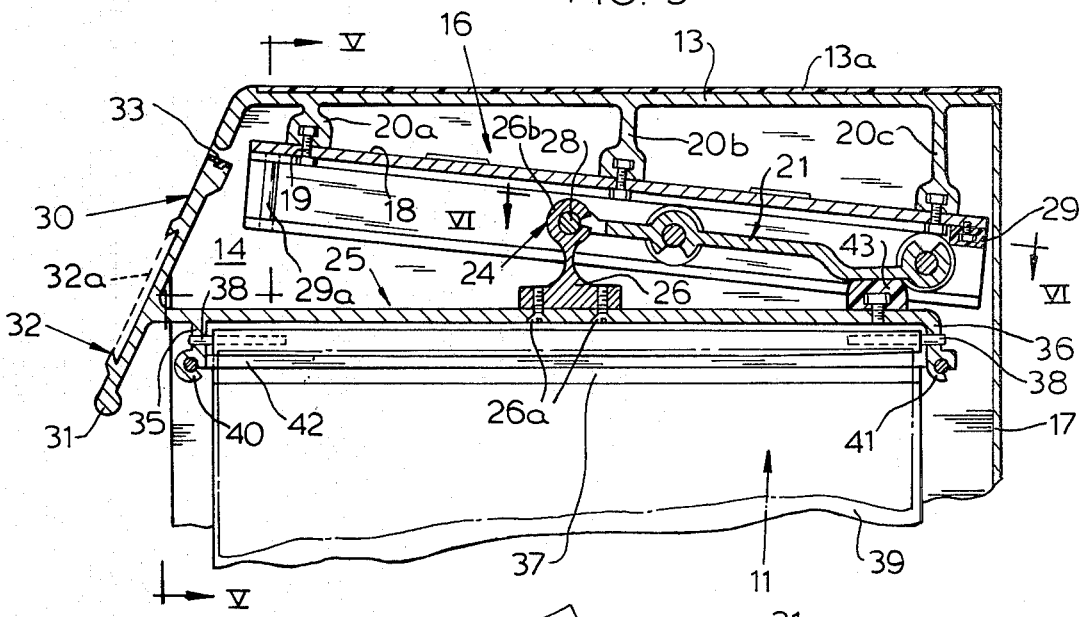
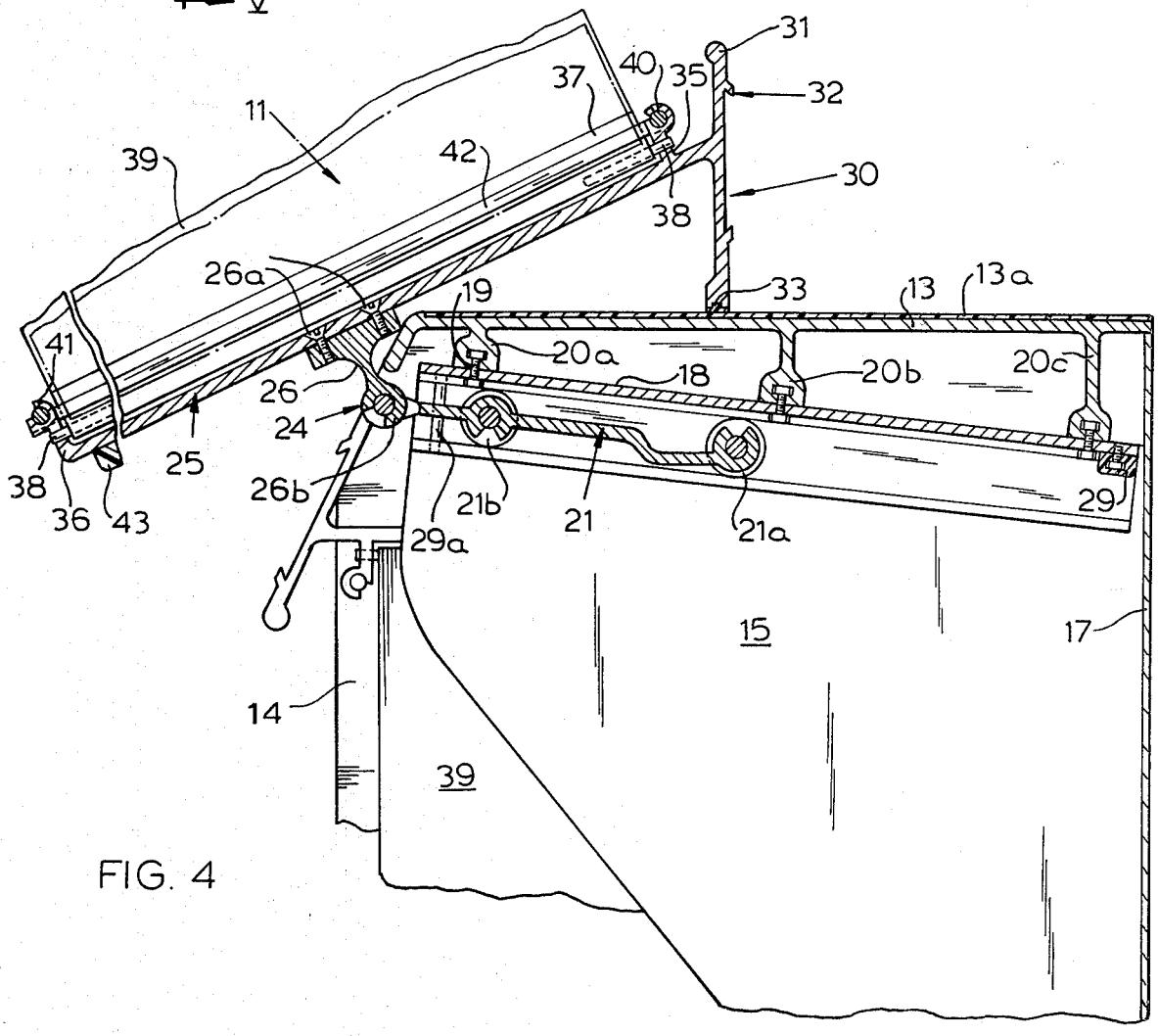
FIG. 4

RESTORABLE GANG APPARATUS FOR TELEPHONE BOOK BINDERS

FIELD OF THE INVENTION

This invention relates to holding or mounting devices or racks for the gang mounting of telephone books and particularly concerns itself with a device which permits the user to select a telephone book from a rack of books and which further permits the user to move the book from a storage position to a telephone book examining position atop of a table overlying the rack and which further permits the user after completing examination to release the book in such a way that the book will swing back to its original storage position on the rack without further assistance by the user.

BACKGROUND OF THE INVENTION

Telephone book storage apparatuses have been used in a number of different places in the past, such as in airports, bank lobbies, lobbies of business buildings, and the like. Various types of telephone book supporting devices have been used in the past, and, for example, one of them is shown in U.S. Pat. No. 2,856,728 which discloses a swingably supported telephone book binder.

Another prior art type of hanger for telephone books is shown in U.S. Pat. No. 3,705,706.

Still another type of telephone book hanger is disclosed in U.S. Pat. No. 3,894,754.

Generally speaking, the present invention is particularly concerned with that type of telephone book storage device which is so constructed as to minimize the possibility of pilferage.

SUMMARY OF THE INVENTION

The present invention relates to a restorable gang apparatus for telephone books which allows the books to be permanently attached thereto, while at the same time permitting the books to be moved on a truck mounted on a track from a storage position clear of the rack so that the telephone book can then be pivoted through an arc and supported in its thus pivoted condition so that the user can then view the interior of the telephone book. The invention also relates to a telephone book holding device that is mounted on a tilted track and arranged so that the device and its book can be normally stored under the top of a shelf or table surface which is a part of a main assembly. When reference is made to the telephone book, an appropriate indicia on the exposed backbone of a telephone book holding device is on display to differentiate it from other book holding devices mounted within the same assembly. According to other features of the invention, a handle is part of the holding device and is contiguous to the part carrying the indicia.

According to still further features of the invention, to open and examine a telephone book requires the user to pull the handle of the device outwardly until it automatically stops and can be rotated upwardly whereupon its protective cover automatically opens away from the telephone book so as to permit the book itself to spill open and to permit the contents to be exposed for viewing.

According to still further features of this invention, when a user finishes his examination of the telephone book, he need do nothing more than release his hold upon the book at which time the book holding device and its contents rotate downwardly. As the book descends, the protective covers are forced to close the telephone book by virtue of interference with other stored books, the main assembly frame, or both. Upon finishing its rotation, the resulting forces cause the book holding device to move inwardly and store itself under the table top portion of the main assembly.

BRIEF DESCRIPTION OF THE DRAWINGS

An exemplary embodiment is described below with reference to the accompanying drawings in which:

FIG. 3 is an enlarged fragmentary vertical cross-sectional view taken on the lines III—III looking in the direction indicated by the arrows as seen in FIG. 2;

FIG. 4 is an enlarged fragmentary cross-sectional view taken on the lines IV—IV looking in the direction indicated by the arrows as seen in FIG. 2;

DESCRIPTION OF AN EXEMPLARY EMBODIMENT

Figure 1:
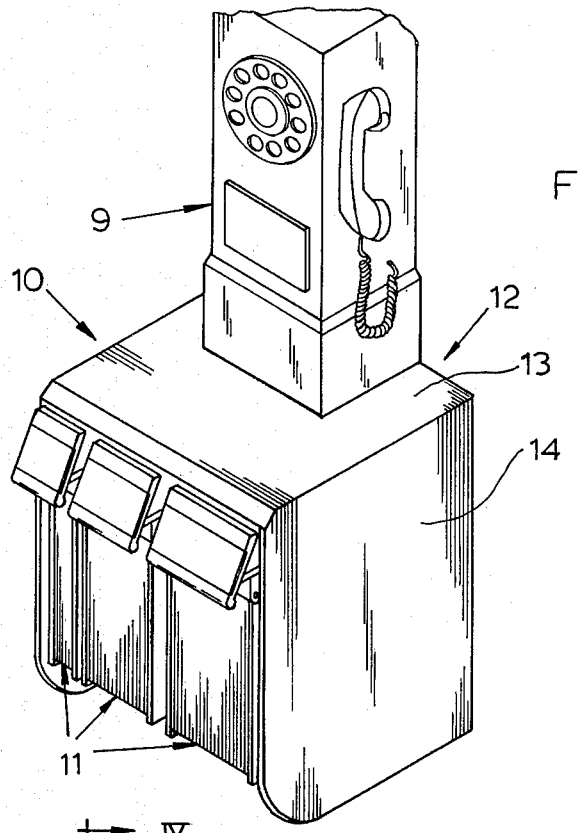
FIG. 1 is a perspective view of a telephone facility with a restorable gang apparatus for telephone books positioned in adjacency.
Figure 2:
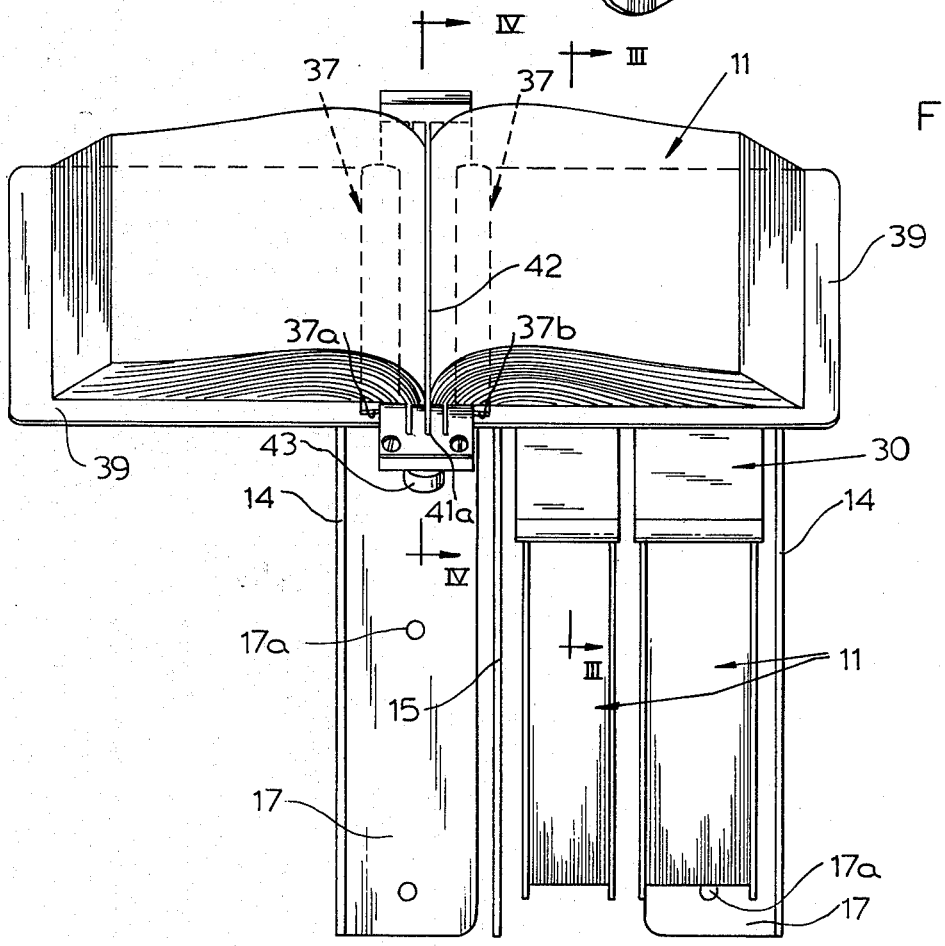
FIG. 2 is a front view of a restorable gang apparatus with a telephone book shown in a viewing position.

The reference numeral 9 indicates generally a telephone with a restorable gang apparatus 10 mounted thereunder in accordance with important features of this invention. The restorable gang apparatus 10 is adapted to coact with telephone books such as are shown in FIG. 2 and elsewhere for the purpose of enabling the telephone books to be easily stored and then retrieved when needed by a user in a simple and convenient manner.

The apparatus 10 includes a main frame indicated generally at 12. The main frame includes a top shelf 13 and spaced end plates 14—14 formed in integral assembly therewith. The top shelf has a synthetic plastic top **13*a* (FIG. 4) which can be comprised of any suitable material to provide a smooth working surface which can be readily cleaned and removed and replaced if necessary. The top 13*a* can be suitably secured on the top shelf 13. The main frame also includes intermediate divider plates 15 (FIG. 2) which are positioned in parallel spaced relation with respect to the spaced end plates 14—14 to provide compartments for each of the telephone books 11 and also for book mounting units as indicated generally at 16. Positioned at a rear relatively closed end of the main frame 12 are rear mounting plates 17—17 which can be secured by any suitable fasteners to a wall by inserting the fasteners through mounting holes 17*a*, all as viewed in FIG. 2**.

Figure 6:
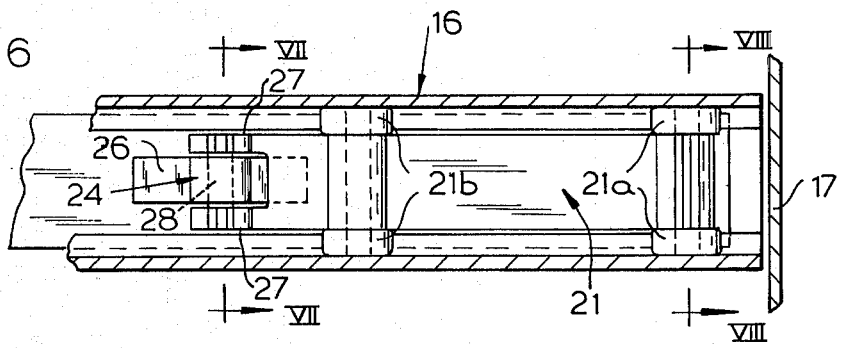
FIG. 6 is an enlarged fragmentary partially sectioned view taken on the line VI—VI looking in the direction indicated by the arrows as seen in FIG. 3.
Figure 7:
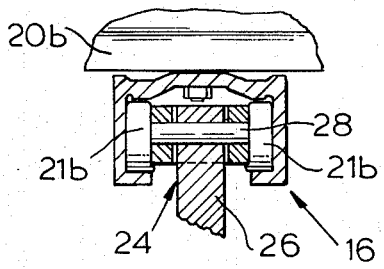
FIG. 7 is an enlarged cross-sectional view taken on the line VII—VII looking in the direction indicated by the arrows as seen in FIG. 6.
Figure 8:
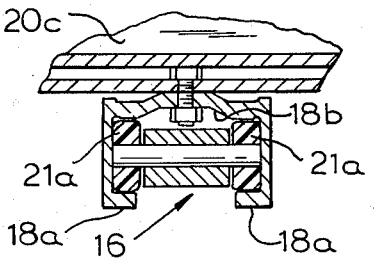
FIG. 8 is an enlarged fragmentary cross-sectional view taken on the line VIII—VIII looking in the direction indicated by the arrows as seen in FIG. 6.
Figure 9:
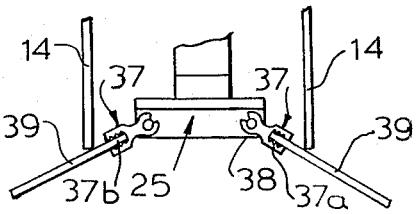
FIG. 9 is a diagrammatic view showing the manner in which the protective covers coact with other stored books, the main assembly frame, or both, for automatically closing the same.

The book mounting units shown in FIGS. 3 and 4 each include an inclined track 18 suspended by bolt type fasteners 19 from an underside of the top shelf 13. The inclined track 18 has opposing channel portions 18*a*—18*a* and a track web 18*b* which serve to join the channel shape track portions 18*a*—18*a* together. The web 18*b* is secured by means of the bolt-type fasteners 19 to the underside of the shelf and through the track mounting brackets 20*a*, 20*b*, 20*c* which have varying lengths so that the track 18 can be suspended in an inclined manner. Mounted upon the inclined track 18 of each of the units 16 is a slidable truck 21. The slidable truck has longitudinally spaced sets of rollers with one set being indicated at 21*a* and the other set being indicated at 21*b* (FIG. 4). These rollers 21*a* and 21*b* are adapted to carry the truck 21 along the inclined slide 18 in the different positions shown in FIGS. 3 and 4 with the telephone book. The rollers 21*a* and 21*b* can be comprised of any suitable material such as nylon and the like, as seen in FIG. 8. Also a stop is provided at the lower end of the track 18 as indicated at 29 for limiting the downward travel of the truck 21 to hold the truck on the track 18. A second pair of stops 29*a* are provided at an upper end of the inclined track 18 to prevent the truck 21 from being disengaged from the inclined track 18 when the slidable truck 21 is moved with the book 11 to position the book 11 in a viewing position as seen in FIG. 4. Provided at an outer forward end of a truck 21 is a rotatable pivot means 24 which is provided for connecting the truck 21 to a telephone book carrier structure 25. The carrier structure 25 constitutes a piece of material preferably an extrusion having a length and a width slightly exceeding that of the book 11 to be mounted thereto. A mounting bracket 26 is mounted or fastened at one end by suitable fasteners 26*a* to the top side of the hinged cover holder as seen in FIG. 3. The opposite end of the mounting bracket 26 has a tubular shape 26*b*. Integral with the truck 21 at its outer or forward end are a spaced pair of tubular pivot end supports 27—27 shown in FIG. 6 which serve to provide internal bearing surfaces for a bearing pin 28 keyed to the mounting bracket 26. As the bracket 26 rotates with the pin 28 on the internal bearing surfaces on the end supports 27—27, the telephone book can be rotated as shown in FIGS. 3 and 4.

Integral with the telephone book carrier structure 25 at its outer end is an inclined flange 30 which extends in an inclined direction toward the table top and which also is extended on opposite upper and lower sides of the carrier structure 25. The lower end of the flange 30 serves as a handle 31. The intermediate portion of the flange 30 is provided with an indicia holder portion 32 for an indicia plate 32*a* and the upper end of the flange 30 is provided with a bumper 33 for engagement with the table top 13 when the telephone book is positioned in its viewing position as seen in FIG. 4. It will be noted from a consideration of the drawings and particularly FIGS. 3 and 4 that the flange 30 constitutes an integral one-piece extrusion with the telephone book carrier structure or plate 25. According to another of the features of our invention, the handle 31 is integral with flange 30. Still further, the top shelf 13 is also a one-piece extrusion and is formed integral with the mounting brackets 20*a*, 20*b*, and 20*c*.

In order to mount the telephone books 11 on the respective book mounting units 16, the telephone book carrying structure 25 has integral longitudinally spaced flanged extensions 35 and 36 (FIG. 3). These flanged extensions 35 and 36 extend downwardly in a direction towards the telephone books when the books are stored in a storage position, as seen in FIGS. 2 and 3. When the telephone book carrying structure is rotated through its arc, then the flanges 35 and 36 extend upwardly while the telephone book carrying structure is disposed in a viewing position, as best seen in FIG. 4. Also provided on the telephone book carrier structure, and co-operable with the flanged extensions 35 and 36 are spaced cover holders 37 which preferably are of an extruded construction. These cover holders are adapted to engage the outer sides of the telephone book when the book is in assembly with the telephone book carrier structure 25. The cover holders 37 are secured at opposite ends to the flanges 35 and 36 by hinge pins 38. The cover holders 37 are each provided with a pair of spaced legs defining a slot 37*b* with the cover 39 engaged therein. The legs 37*a* are secured by rivets or other suitable fasteners to protective covers 39 which are engaged at outer sides of each of the telephone books 11. In other words, a pair of the covers 39 are provided for each of the books. The number of compartments can be varied for enabling a preselected number of the book mounting units 16 to be installed therewith corresponding to the number of telephone books 11 that are intended to be used in the apparatus.

Figure 5:
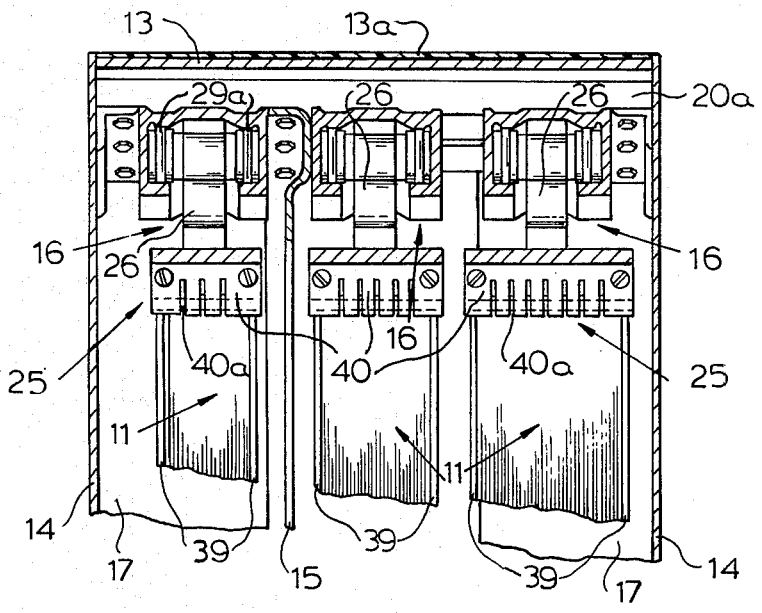
FIG. 5 is a vertical section with parts shown in elevation taken on the line V—V looking in the direction indicated by the arrows as seen in FIG. 3.

In order to assemble the telephone books 11 with the telephone book carrier structure 25, flanged extensions 35 and 36 are provided with slotted hooked ends 40 and 41 (FIG. 4) having slots 40*a* and 41*a* (FIG. 5). A book retainer 42 is provided to secure each of the books 11 in assembly with the telephone book carrier structure. The book retainer constitutes a rod-like member having a tapered end that is adapted to engage in the slots in one of the slotted hooked ends and the book retainer 42 also has a hooked end at an opposite end and is adapted to engage with the other of the slotted hooked ends to thereby provide means for securing the telephone book 11 in assembly. Any suitable means can be utilized for this purpose.

It will thus be seen that when it is desired to release the telephone book 11 to allow the telephone book to move from a viewing position to a storage position that the user need only to grasp the handle 33 or to push downwardly upon the book 11 at its lower end to upset the balance so as to cause the book 11 and its telephone book carrying structure 25 to rotate on the rotatable pivot means 24 whereupon as the rotation of the book 11 commences the protective covers 39 strike the spaced end plates 14. In returning the book 11 to storage, the slidable truck 21 is caused to move downwardly on the inclined track 18 until the slidable truck reaches an at-rest position which in the illustrated embodiment would be where stop 43 on plate 25 strikes the slidable truck 21. Where the user desires to remove one of the telephone books from the storage position, then the truck 21 is moved outwardly until the wheel bearing 21*b* strikes the stop 29*a* whereupon the telephone book can be rotated in a viewing position as previously described.

The vertical pivot axis of the rotatable pivot means 24 is off center with respect to the center of gravity of the telephone book carrying structure 25 prohibiting counter rotation of the telephone book carrying structure when it is in its at rest telephone book viewing position as seen in FIG. 4. This same disposition of the rotatable pivot means 24 relative to the center of gravity also serves to hold the stop against the truck 21 when the telephone book carrier structure 25 and the book 11 are in a storage position as seen in FIG. 3.

With respect to the present invention, it will thus be seen that the following important new features have been described and illustrated herein:

(1) Indicia, handle, and book-holder are all one and the same piece;

(2) The book-holder cooperates with a tilted track, stop and its own holder to produce ostensibly automatic:

(A) Rotation of book upwardly into place for viewing of book contents;

(B) Restoration of book downwardly by gravity and in to rest.

(3) Ostensibly automatic opening and closing of protective covers which "unclamps" or closes the telephone book.

(4) Easy adaptation of book-holding device components to handle any telephone book width between perhaps ¼" and 4".

(5) Easy adaptation of book-holding device components to handle any combination of more than one book of the same or dissimilar widths.

(6) A protective shelf of variable length for selfstored telephone book-holding devices or the like.

We claim as our invention:

1. In a restorable gang apparatus for one or more telephone books including a main frame having a top shelf and spaced end plates depending downwardly generally at opposite ends of the shelf with one or more telephone books being normally storable on the bottom side of the shelf, the improvement comprising:

a plurality of book mounting units suspended from beneath the top shelf between the spaced end plates in a storage position and with each unit comprised, as follows:

a track, an inclined track hanger means suspending the track in an inclined position with a forward end of the track being more elevated than a rearward end of the track, a truck having slidable bearing means mounted on the track for back and forth movement on the inclined track, telephone book carrier structure beneath said track, rotatable pivot means suspending said telephone book carrier structure from said truck, means for mounting the telephone book onto said telephone book carrier structure, and a handle operatively connected to said telephone book carrier structure and pullable in a direction causing said truck to move upwardly on said track and for placement of said rotatable pivot means in adjacency to a front edge of said top shelf and for then enabling the telephone book carrier structure to rotate on its rotatable pivot means for positioning at least a portion of said telephone book carrier structure in overlying relation to said top shelf for placing the telephone book carrier structure and the telephone book in a viewing position, the vertical axis of the rotatable pivot means being off center with respect to the center of gravity of the telephone book carrying structure prohibiting counter rotation of the telephone book carrying structure when in an at rest telephone reviewing position, said telephone book carrier structure having an upwardly extending flange positioned at its outer end with a lower portion of the flange comprising said handle and by an upper portion of said flange having a top shelf engaging end for supporting the telephone book carrier structure and the telephone book when in a viewing position.

2. The apparatus of claim 1 further characterized by said flange having means for holding an indicia plate thereon for identifying each telephone book when in a storage position.

3. The apparatus of claim 1 further characterized by said flange and said telephone book structure comprising an integral one piece extrusion.

4. In a restorable gang apparatus for one or more telephone books including a main frame having a top shelf and spaced end plates depending downwardly generally at opposite ends of the shelf with one or more telephone books being normally storable on the bottom side of the shelf, the improvement comprising:

a plurality of book mounting units suspended from beneath the top shelf between the spaced end plates in a storage position and with each unit comprised, as follows:

a track, an inclined track hanger means suspending the track in an inclined position with a forward end of the track being more elevated than a rearward end of the track, a truck having slidable bearing means mounted on the track for back and forth movement on the inclined track, telephone book carrier structure beneath said track, rotatable pivot means suspending said telephone book carrier structure from said truck, means for mounting the telephone book onto said telephone book carrier structure, and an outer flange operatively movable with and fixedly connected to said telephone book carrier structure and having one end that comprises a handle, the handle being pullable in a direction causing said truck to move upwardly on said track and for placement of said rotatable pivot means in adjacency to a front edge of said top shelf and then being rotatable with the telephone book carrier structure on said rotatable pivot means positioning at least a portion of said telephone book carrier structure in overlying relation to said top shelf for placing the telephone book carrier structure and the telephone book in a viewing position, the vertical axis of the rotatable pivot means being off center with respect to the center of gravity of the telephone book carrying structure prohibiting counter rotation of the telephone book carrying structure when in an at rest telephone reviewing position, the flange having a bumper at its opposite end for supporting the book carrier structure upon said shelf when the book is in a viewing position.

5. The apparatus of claim 4 further characterized by said outer flange and said telephone book carrier structure comprising an integral one piece extrusion and with the handle and the bumper positioned on opposite sides of said telephone book carrier structure.

6. The apparatus of claim 4 further characterized by a plurality of said units being positioned in side-by-side relation beneath said top shelf for carrying a series of telephone books.

* * * * *